US006758069B2

(12) United States Patent
Derman

(10) Patent No.: US 6,758,069 B2
(45) Date of Patent: Jul. 6, 2004

(54) COMPUTER PHYSICAL SECURITY DEVICES

(75) Inventor: Jay Derman, San Mateo, CA (US)

(73) Assignee: ACCO Brands, Inc., Lincolnshire, IL (US)

( * ) Notice: Subject to any disclaimer, the term of this patent is extended or adjusted under 35 U.S.C. 154(b) by 0 days.

(21) Appl. No.: 10/232,990

(22) Filed: Aug. 30, 2002

(65) Prior Publication Data

US 2004/0040350 A1 Mar. 4, 2004

(51) Int. Cl.[7] ..... E05B 69/00
(52) U.S. Cl. ..... 70/58; 70/14; 70/18; 248/551
(58) Field of Search ..... 70/14, 18, 19, 70/57, 232, 58, 30, 49; 248/551–553

(56) References Cited

U.S. PATENT DOCUMENTS 4,462,233 A * 7/1984 Horetzke ..... 70/428
4,738,428 A * 4/1988 Themistos et al. ..... 70/58 X
5,327,752 A * 7/1994 Myers et al. ..... 70/58
5,381,685 A * 1/1995 Carl et al. ..... 70/14 X
5,493,878 A * 2/1996 Murray, Jr. et al. ..... 70/58
5,502,989 A * 4/1996 Murray, Jr. et al. ..... 70/58
5,791,171 A * 8/1998 Kelley ..... 70/58
5,875,657 A * 3/1999 Kelley ..... 70/18
5,913,907 A * 6/1999 Lee ..... 70/58
6,000,251 A * 12/1999 Murray, Jr. et al. ..... 70/58
6,000,252 A * 12/1999 Murray, Jr. et al. ..... 70/58
6,006,557 A * 12/1999 Carl et al. ..... 70/58
6,038,891 A * 3/2000 Zeren et al. ..... 70/58
6,112,561 A * 9/2000 Carl ..... 70/58
6,112,562 A * 9/2000 Murray, Jr. et al. ..... 70/58
6,155,088 A * 12/2000 Murray, Jr. et al. ..... 70/58
6,170,304 B1 * 1/2001 Ohta ..... 70/14
6,205,824 B1 * 3/2001 Miao ..... 70/58
6,212,918 B1 * 4/2001 Kravtin ..... 70/14
6,227,017 B1 * 5/2001 Igelmund ..... 70/58
6,244,080 B1 * 6/2001 Sakurai ..... 70/14
6,257,029 B1 * 7/2001 Liao ..... 70/58

* cited by examiner

*Primary Examiner*—Suzanne Dino Barrett
(74) *Attorney, Agent, or Firm*—Townsend and Townsend and Crew LLP

(57) ABSTRACT

Security locks for portable electronic devices and other portable devices that have a relatively high economic value. The locks include housings that have a locking member extending therefrom. The locking member extends into a slot defined within the portable device and is configurable into a locked configuration that inhibits removal from the slot. The housing is coupled to a separate object that prevents movement of the portable device away from the object when the locking member is in the locked configuration.

2 Claims, 11 Drawing Sheets

COMPUTER PHYSICAL SECURITY DEVICES

CROSS-REFERENCES TO RELATED APPLICATIONS

NOT APPLICABLE

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK.

NOT APPLICABLE

BACKGROUND OF THE INVENTION

The present invention relates to an apparatus and method for inhibiting the theft of small and portable devices that have a relatively high economic value, specifically portable electronic devices having a rigid wall.

Computers and electronic devices have evolved rather rapidly from large, expensive machines usable only by a few, to relatively small, portable devices which are usable by many. In particular, the development of desk top computers with significant processing power has made computers available to the general population. It is now common for students of all ages to have their own computer, and desk top computers are in wide spread use as word processors and work stations in almost all forms of business. Desk top computers are relatively small and easily transportable, and an undesirable side effect of their proliferation is the fact that the theft of such computers is a significant problem. A variety of devices have been developed to inhibit the theft of desk top computers and similar equipment. Since desk top computer systems involve several components, typically including the computer itself, a separate monitor, keyboard and often a printer, such security systems often employ a cable which attaches each of the components to each other and to a relatively immovable object such as a desk. The principal difficulty in such systems is providing an effective and convenient method for attaching the cable itself to the equipment. Kensington Microware Limited, assignee of this application, provided a security system which is especially designed for use with particular Apple computers. Certain Apple computer components have slots and internal brackets designed to capture a specially designed tab inserted through the slot so that the tab is not removable. While this system was effective for particular types of Apple computers, it did not work for those Apple computer components and other computer brands which did not have the special designed slots and brackets.

It is undesirable to require a computer to have specially designed slots with internal capture brackets because the brackets occupy a significant amount of space in an item of equipment which is intended to be as space efficient as possible. Different items of Apple equipment required different sized slots, meaning that the security mechanism must provide a variety of different sized tabs. The tabs, once inserted, could not be removed without damage to the equipment, meaning that the security system could not be moved from one computer to the other. Even Apple computers with specially designed slots are typically used with peripheral equipment which does not have the slots, and, the Kensington system provided screws requiring a special screwdriver which replaced the screws used to attach the existing communication cables, securing the peripheral equipment to the base computer by preventing unauthorized removal of the communication cables. This last aspect of the system had a drawback in that the peripheral equipment could not be removed from the base computer without the special screwdriver, which could be lost or misplaced.

Other vendors provided security systems which were not required to interface directly with special slots and capture mechanisms as provided in certain Apple computers. For example, Secure-It, Inc., under the trademark "KĂBLIT", provided a variety of brackets attached to the computer component using existing mounting screws, i.e., screws which are already used to secure items of equipment within the cabinet. Typically, the bracket is apertured so that passage of the cable through the aperture prevented access to the mounting screw and thus prevented removal of the bracket from the equipment. A deficiency of this type of system is that it required the removal of the existing mounting screw, which may cause some damage to the internal components of the computer. Suitable existing screws are not always available on certain peripherals for convenient attachment of the fastener. For this latter reason, KĂBLIT also provided glue-on disks which, unfortunately, are permanently secured to the equipment.

The theft of small but expensive equipment such as desk top computers continues to be a growing problem. Prexisting devices were simply too inefficient or ineffective, or their application was too limited. As a result, the use of such security systems is rare, computer equipment is typically left unprotected, and it is all too often stolen. Advancements in the state of the art of electronic devices have led to smaller yet more powerful devices. For example, computers have evolved from very large machines to relatively small, portable, or even hand-held machines. The use of many different types of so-called "lap-top" computers and the smaller hand-held "personal digital assistants" (PDAs) has proliferated within personal, educational and business environments. However, an undesirable side effect of ever-shrinking electronic devices is the easy access and asportation by others, especially thieves or others desiring unauthorized use of the electronic device. One problem is that no viable physical security device exists for some modem portable electronic devices. Compounding the problem is that some portable electronic devices are neither designed for attaching an object to it such as a security device for locking to another article, nor provided with a dedicated security slot, such as those described in U.S. Pat. No. 5,381,685, assigned to ACCO Brands, and the assignee of the present invention.

While the inventions of the incorporated patents describe many effective solutions to computer physical security that are useful in particular applications, there are some applications and situations in which other solutions may be useful.

SUMMARY OF THE INVENTION

The present invention provides security locks for portable electronic devices and other portable devices that have a relatively high economic value. In accordance with one embodiment of the present invention, a locking system for engaging a security slot of about 3 mm by 7 mm includes a first housing telescopically coupled to a second housing and moveable from a first position to a second position. The housings include apertures that align when in the second position. A slot engaging member is coupled to the second housing, and is sized to enter into the security slot. The slot engaging member includes a locking arm coupled to the first housing that retracts when the first housing is in the first position and the locking arm extends when the first housing is in the second position. An object extends through the aligned apertures to retain the first housing in the second position.

In accordance with another embodiment of the present invention, An interface element for a security slot having dimensions of about 3 mm by 7 mm includes a housing, a slot-engaging member coupled to the housing and sized to fit within the security slot, and a locking arm, moveably coupled to the slot-engaging member. The locking member defines, in relation to the security slot and the slot-engaging member, a locked configuration when the locking arm is misaligned with the security slot, and an unlocked configuration when the locking arm is aligned with the security slot.

In accordance with a further embodiment, an interface element for a security slot having dimensions of about 3 mm by 7 mm includes a plate, a slot engagement member, coupled to said plate, sized to enter into the security slot, a ring, coupled to the slot engagement member and sized to enter into the security slot, and a ring adjustment system for configuring the ring to be unremovable from within the security slot.

In accordance with yet another embodiment of the present invention, an interface element for a security slot having dimensions of about 3 mm by 7 mm includes a plate, and a slot engagement member threadably coupled to the plate. The slot engagement member includes a locking member sized to enter into the security slot and to be misalignable with the security slot. The slot engagement member has a distance between the plate and the locking member that is adjustable such that the plate may be contacted with a wall defining the security slot and tightened when the locking member is misaligned with the security to retain the plate next to the wall.

The preferred exemplary embodiments of this invention will now be discussed in detail. These embodiments depict the novel and nonobvious locking apparatuses of this invention shown in the accompanying drawings, which are included for illustrative purposes only, with like numerals indicating like elements.

DETAILED DESCRIPTION OF THE INVENTION

Figure 1:
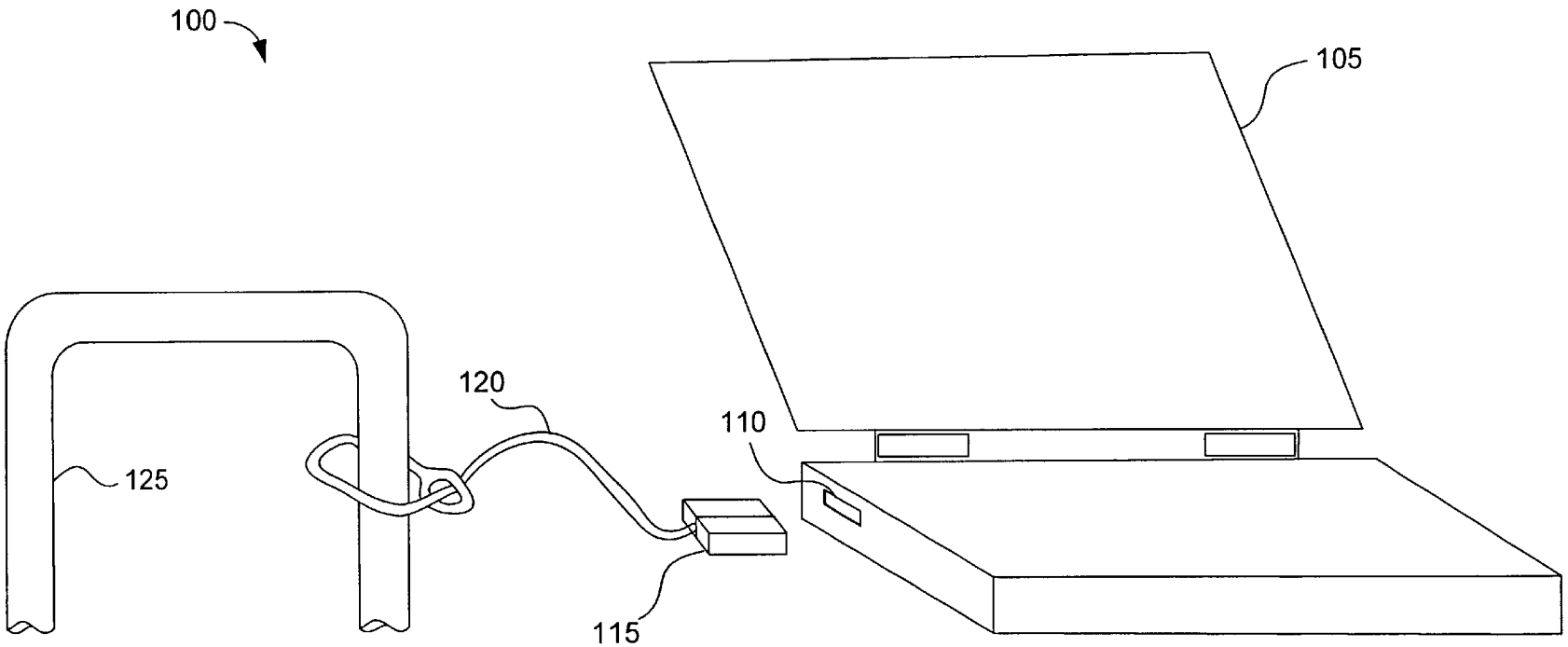
FIG. 1 is a perspective plan view of a preferred embodiment for a physical security system according to a preferred embodiment.

FIG. 1 is a perspective plan view of a preferred embodiment for a physical security system 100 according to a preferred embodiment. Security system 100 is designed to inhibit theft of a portable device 105 through physical detention by localizing the portable device to a predetermined locale. Portable device 105 may be, for example, a laptop computer, personal digital assistant (PDA), MP3 player or other valuable or difficult to replace item. Portable device 105 is preferably equipped, during manufacture or retrofit, with a standard security slot 110 having dimensions of about 3 mm by about 7 mm, and adaptable to a portion of a wall of a housing of portable device defining slot 100.

Security system 100 includes an interface element 115 that engages security slot 110 and typically includes a locked configuration and an unlocked configuration. In the unlocked configuration, interface element 115 is engageable with and disengageable from slot 110. In the locked configuration, interface element 115 resists disengagement from slot 110. A locking system, either keyed, combination, or physical interlocking depending upon the application and design considerations may be used to maintain interface element 115 in the locked configuration until a user desires to disengage security system 100.

Security system 100 includes a localizer 120 coupled to interface element 115. Localizer 120 is typically a cable or other physical attachment system that is designed to be associated with an object 125 that is not part of portable device 105. The association of localizer 120 with object 125 constrains movement of portable device 105 within a predetermined distance of object 125. In other embodiments, localizer 125 may be a wireless/electronic solution such as, for example, inventory control tags used in many retail stores. Security slot 110 is desirably placed so as to not interfere with operation of portable device 105.

For the embodiments described herein, the localization and the retention of interface element 115 in a locking configuration are generally secondary considerations. While very important to actual use of these devices as an anti-theft deterrent, there are many known ways of implementing localization and maintenance of mechanical interrelationships (i.e., holding locking elements into a desired relationship such as for example the key, the combination, the physical cable interlock solutions) that the primary focus of the following description is on the manner of the engagement of interface element 115 to security slot 110.

Figure 3:
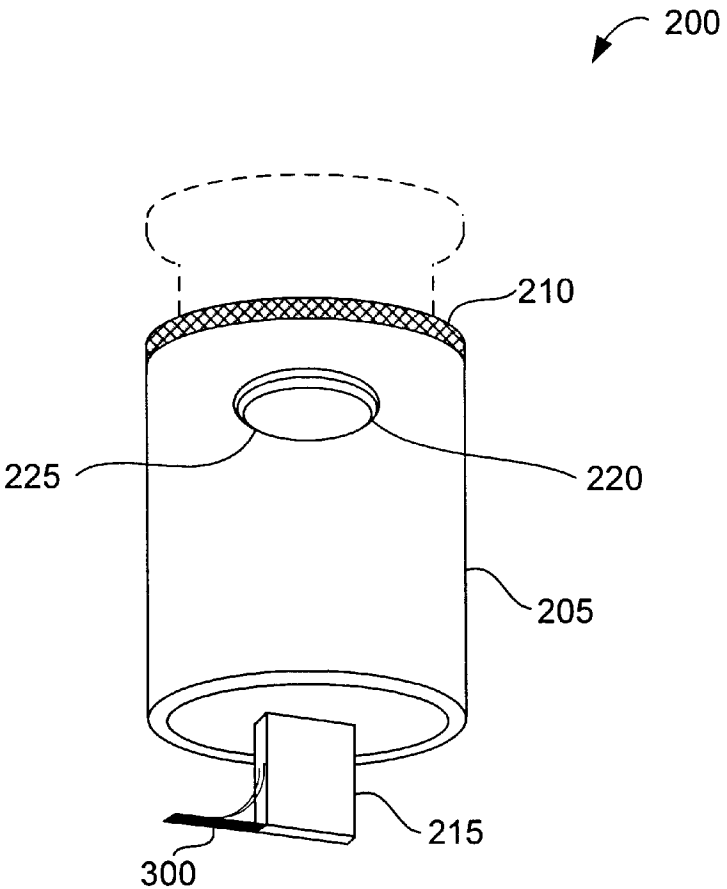
FIG. 3 is a perspective view of the preferred embodiment for the interface element of FIG. 2 in a locked position.
Figure 2:
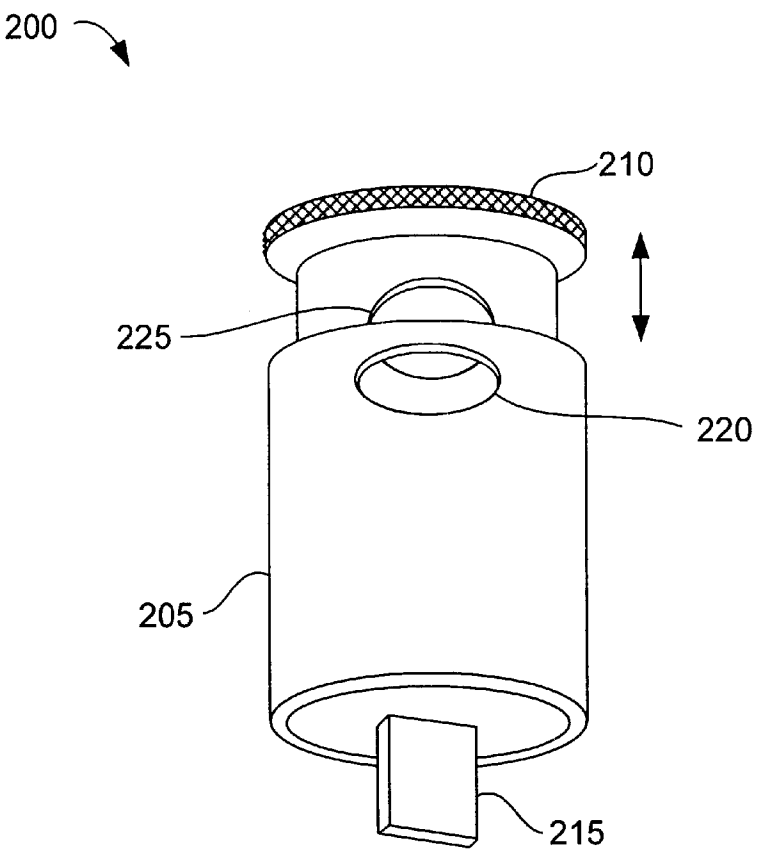
FIG. 2 is a perspective view of a preferred embodiment for an interface element in an unlocked position.

FIG. 2 is a perspective view of a preferred embodiment for an interface element 200 useable as interface element 115 shown in FIG. 1 illustrated in an unlocked configuration. Interface element 200 includes two telescoping cylinders, an outside cylinder 205 and an inside cylinder 210, and a slot engaging member 215. Slot engaging member 215 is adapted to fit within security slot 110, and is coupled to a base of outside cylinder 205. Outside cylinder 205 and inside cylinder 210 include pass-through apertures 220 and 225 that align when interface element 200 is in the locked configuration shown in FIG. 3. FIG. 3 is a perspective view of interface element 200 of FIG. 2 in the locked configuration. Telescoping inside cylinder 210 is coupled to a locking flange 300 that extends from one or more sides of slot engaging member 215 when inside cylinder telescopes into outside cylinder 205, and retracts within slot engaging member 215 when inside cylinder telescopes out of outside cylinder 205. Locking flange 300 may be a pivoting locking leg as shown, or cam-actuated ball bearings. An object passing through aligned apertures 220 and 225, such as localizer 125 or a padlock coupled to localizer 125, or other structure, retains interface element 200 in the locked configuration.

In operation, interface element 200 is operated into the unlocked configuration shown in FIG. 2, and slot-engaging member 215 is inserted into security slot 110. Inside cylinder 210 is telescoped into outside cylinder 215 to transition interface element to the locked configuration in which locking flange 300 extends behind the wall defining security slot 110 to retain interface element 200 in engagement with portable device 105. An object, for example such as localizer 125 when implemented as a cable or padlock coupled to a cable, passed through aligned apertures 220 and 225 retains interface element 200 in the locked configuration.

Figure 4:
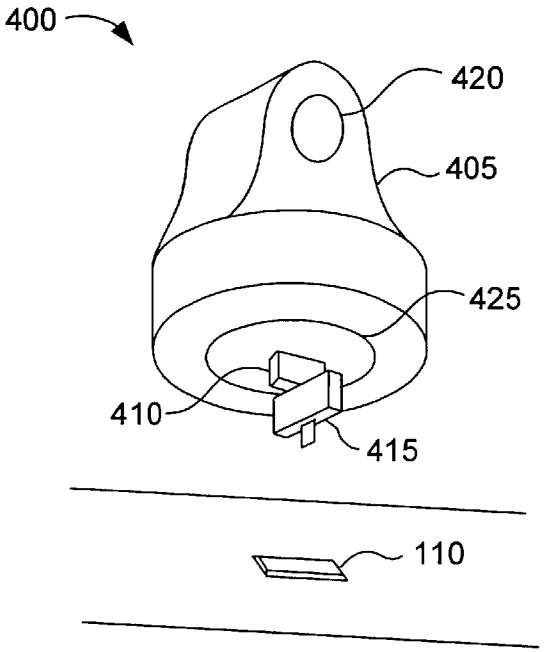
FIG. 4 is a perspective view of an alternate preferred embodiment for an interface element in a locked configuration.

FIG. 4 is a perspective view of a preferred embodiment for an interface element 400 useable as interface element 115 shown in FIG. 1 illustrated in the locked configuration, but outside security slot 110 for ease of reference. Interface element 400 includes a housing 405 having a slot-engaging member 410 extending from a bottom. Pivotally coupled to slot engaging member 410 is a locking arm 415 that rotates about a shaft having an axis of rotation that is generally perpendicular to and passes through security slot 110. Locking arm 415 and its position relative to slot engaging member 410 define the unlocked and locked configurations for interface element 400. When locking arm 415 is aligned with slot engaging member 410, interface element 400 is in the unlocked configuration. When locking arm 415 is misaligned with slot engaging member 410, interface element 400 is in the locked configuration. Housing 405 includes an aperture 420 for receipt of a cable that may be part of localizer 125. In a preferred embodiment, movement of locking arm 415, and the interface element configuration is controlled by access through a channel (not shown) defined through housing 405 that is generally co-axial with the shaft. Passing an object through aperture 420 blocks access to the channel, inhibiting operation of locking arm 415. In certain applications, slot-engaging member 410 may be coupled to a coupling element 425 that is rotatable within housing 405 to allow rotation of housing 405 when interface element 400 engages security slot 110. While locking arm 415 is shown as a rotatable element, in some applications other configurations could be implemented, as described above with respect to the FIG. 2 embodiment.

In operation, locking arm 415 is moved to the unlocked configuration, and slotengaging member 410 is inserted within security slot 110. Locking arm 415 is moved to the locked configuration to misalign itself with security slot 110. An object is passed through aperture 420 and interface element 400 is localized as described above.

Figure 5:
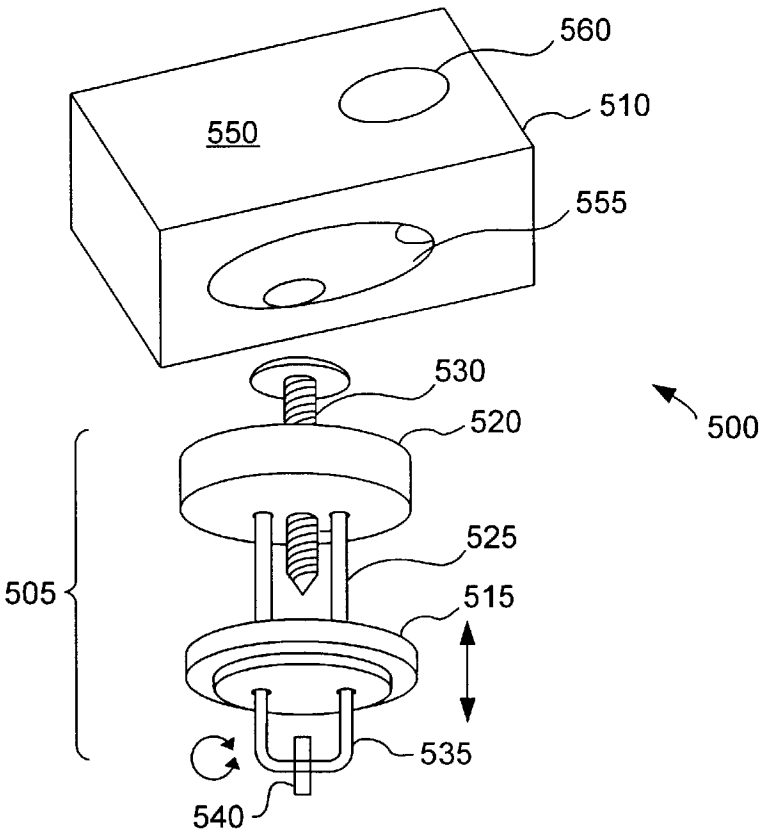
FIG. 5 is an expanded perspective view of an alternate preferred embodiment for an interface element in an unlocked configuration.

FIG. 5 is a perspective view of a preferred embodiment for an interface element 500 useable as interface element 115 shown in FIG. 1 illustrated in the unlocked configuration. Interface element 500 includes two sub-systems—a slot engagement subsystem 505 and an attachment subsystem 510. Engagement subsystem 505 includes two parallel, matching plates: a first plate 515 and a second plate 520. Both plates have two aligned apertures through which a hardened steel 'U-shaped' rod 525 is coupled so that first plate 515 is slidable with respect to first plate 515. Second plate 520 includes an adjustment screw 530 that controls a distance separating the two plates, and thus controls the depth of a bight 535 extending from first plate 515. Bight 535 includes a rotatably coupled locking arm 540. Bight 535 and locking arm 540 define the locking configuration and unlocking configuration for interface 500. Locking arm 540 is rotated to be coplanar with the two loops of rod 525 to define the unlocked configuration. In this mode, bight 535, along with locking arm 540, is insertable into security slot 110. Locking arm 540 is moved out of the plane defined by rod 525 and is secured within security slot 110.

Screw 530 pushes first plate 515 away from second plate 520 and towards bight 535 to inhibit realignment of locking arm 540 with the plane of rod 525. Further rotation snugs first plate 515 up against an outside of a wall defining security slot 110.

Attachment subsystem 510 couples to engagement subsystem 505 when engagement subsystem 505 is in the locked configuration. Attachment subsystem 510 includes a housing 550 having a cylindrical cavity 555 with a peripheral profile matching the plate profile so that the plates may extend up into cavity 555. A specially positioned aperture 560 passes through a side of housing 550 perpendicular to an axis of cylindrical cavity 555. Aperture 560 is positioned such that it passes into and through cylindrical cavity 555 at a point that would be between the two plates of engagement subsystem 505 when engagement subsystem 505 is inserted into cavity 555. An object is passed through aperture 560, holding engagement subsystem 505 within attachment subsystem 510 by positioning between the plates. Interface element 500 is localized as described above.

Figure 6:
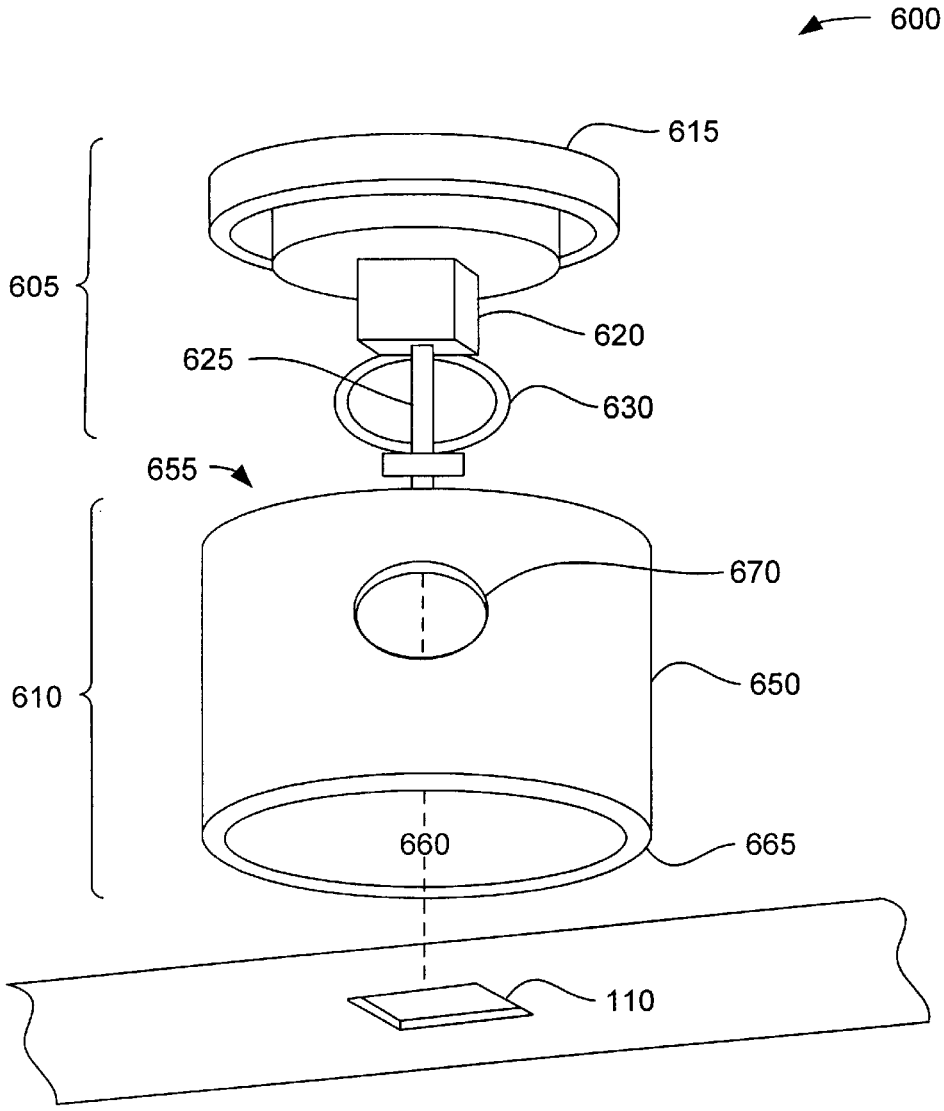
FIG. 6 is an expanded perspective view of an alternate preferred embodiment for an interface element in an unlocked configuration.

FIG. 6 is a perspective view of a preferred embodiment for an interface element 600 useable as interface element 115 shown in FIG. 1 illustrated in the unlocked configuration. Interface element 600 includes two sub-systems—a slot engagement subsystem 605 and an attachment subsystem 610. Engagement subsystem 605 includes a plate 615 having a slot engagement member 620, a locking screw 625 axially threaded through plate 615 and engagement member 620 (accessible from a top of plate 615), a crushable locking ring 630 mounted on said screw 625 between engagement member 620 and a cap 635 affixed to a distal end of screw 625. A diameter of ring 630 is sized to fit within security slot 110. When ring 630 is aligned with a plane containing slot engagement member 620, slot engagement member 620 and ring 630 fit with security slot 110. The locked and unlocked configurations are established by the relationship of engagement member 620 and ring 630 to each other and to slot 110. For temporary (with respect to disengagement of engagement subystem 605 from slot 110) attachment, screw 625 controls rotational alignment of ring 630 relative to slot 110. For permanent attachment, screw 625 crushes and flattens ring 630 past security slot 110, producing a non-removable solution.

Attachment subsystem 610 includes a housing 650 having a cavity 655 and an opening 660 at a bottom end 665. Opening 660 includes a rim designed to match a complementary rim of plate 615 such that plate 615 may rotatably engage bottom end 665 and permit engagement member 620 and ring 630 to extend outwardly. An aperture 670 passes through a wall of housing 650 and positioned sufficiently above bottom end 665 so plate 615 would not interfere with an object extending through aperture 670. The general configuration of attachment subsystem 610 is a cup with a hole in the bottom and a pair of holes in the sidewalls.

In operation, engagement subsystem 605 is coupled into cavity 655 and through bottom end 665 to be rotationally secured within housing 650. Slot engagement member 620 and ring 630 are passed into slot 110 (with ring 630 passing through slot 110) and screw 625 manipulates ring 630 to put interface element 600 into the locked configuration (temporarily or permanently as discussed above). An object is passed through aperture 670 and interface element 600 is localized as described above, which in the temporary locking configuration, also inhibits manipulation of screw 625 while the object passes through aperture 670.

Figure 7:
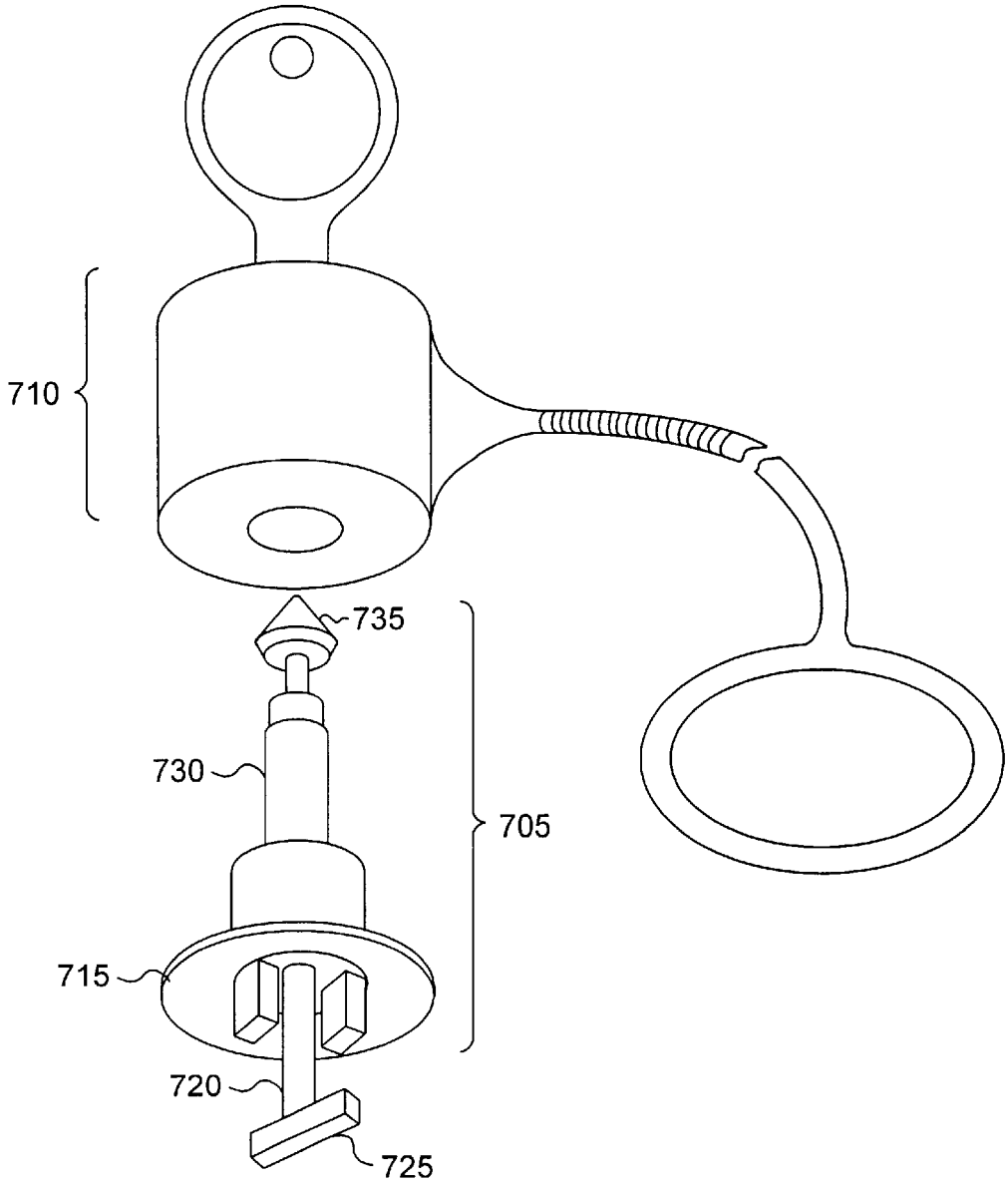
FIG. 7 is an expanded perspective view of an alternate preferred embodiment for an interface element in an unlocked configuration.

FIG. 7 is a perspective view of a preferred embodiment for an interface element 700 useable as interface element 115 shown in FIG. 1. Interface element 700 includes two subsystems—a slot engagement subsystem 705 and an attachment subsystem 710. Engagement subsystem 705 includes a plate 715 having a pair of pins extending on opposite sides of an opening from which a locking element 720 extends. Locking element 720 has a locking member 725 that is insertable within slot 110 at a first end and a second end that has threads for mating to complementary taps of a holding element 730. Holding element 730 includes a mating end 735 for snap-in engagement with a locking system. The locking system is provided as part of attachment subsystem 710 having a key-controlled lock that mates with and engages/disengages with mating end 735.

In operation, locking element 720 is inserted into slot 110 and locking member 725 misaligned with slot 110. Holding element 730 is manipulated to draw the second end up into holding element 730 that engages the pins into slot 110. Interface element 700 is in a locked configuration when locking member 725 is misaligned behind slot 110 and pins of plate 715 engage slot 110. An unlocked configuration is extraction of pins from within slot 110 and alignment of locking member 725 with slot 110. In the locked configuration, mating end 735 snaps into attachment subsystem 710. Localization is achieved in the preferred embodiment by use of a cable coupled to attachment subsystem 710.

Figure 8:
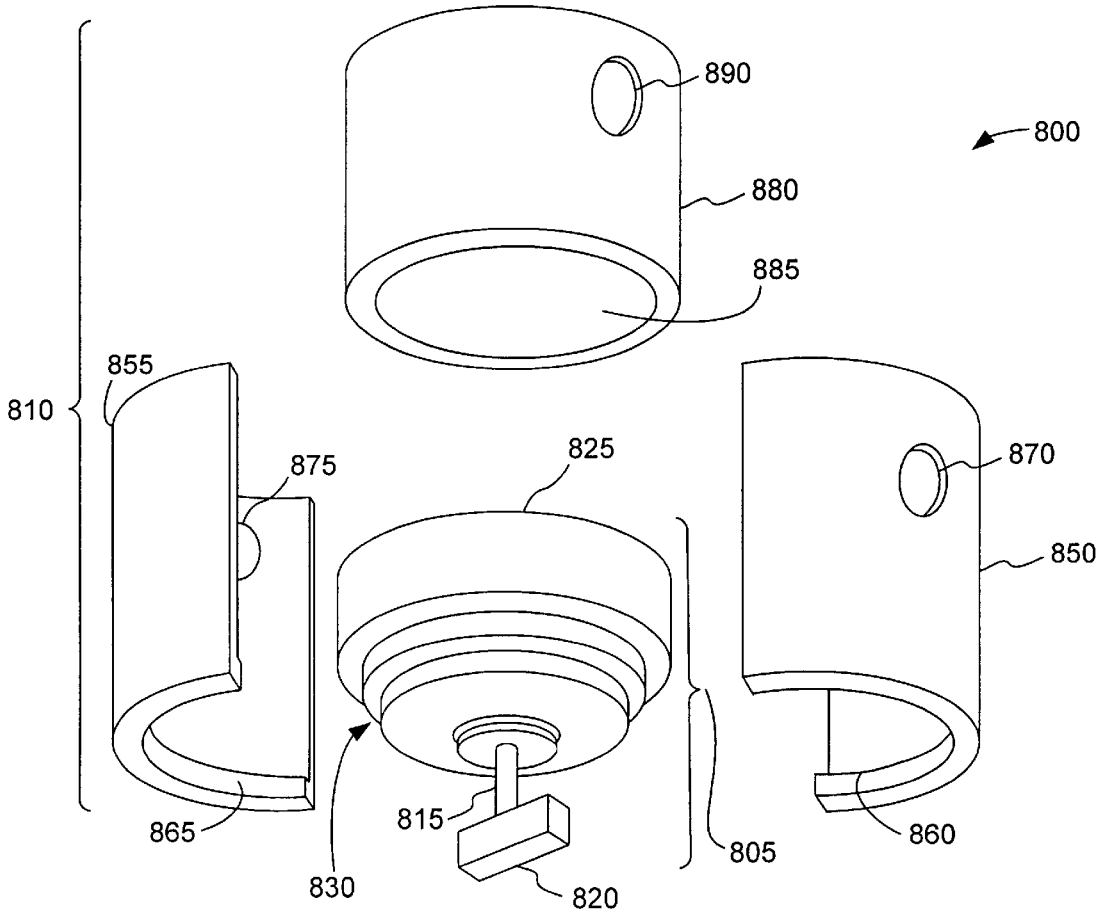
FIG. 8 is an expanded perspective view of an alternate preferred embodiment for an interface element in an unlocked configuration.

FIG. 8 is a perspective view of a preferred embodiment for an interface element 800 useable as interface element 115 shown in FIG. 1 illustrated in the unlocked configuration. Interface element 800 includes two sub-systems—a slot engagement subsystem 805 and an attachment subsystem 810. Engagement subsystem 805 includes a slot engagement member 815 having a locking element 820 at a first distal end and a threaded portion at a second distal end. A plate 825 has a central opening with threads complementary to the threaded portion of slot engagement member 815. Plate 815 also includes a circumferential rim 830. In operation, engagement subsystem 805 implements the unlocked configuration by aligning locking element 820 with security slot 110, and implement the locked configuration by misaligning locking element 820 with security slot 110. Plate 825 is rotated and tightened by use of the threaded portion and secures locking element 820 in the locked configuration.

Attachment subsystem 810 includes a pair of half-cylinder elements 850 and 855 that are designed to surround plate 825 and each half-cylinder element includes a mating rim 860 and 865 respectively for engaging rim 830 of plate 825, and an aperture 870 and 875 respectively, each of which is aligned with the aperture in the other half-cylinder when both are mated to plate 825 of engagement subsystem 805. A housing 880 having a cylindrical cavity 885 sized to receive both half-cylinders when mated to plate 825 includes an aperture 890 that is aligned with apertures 870 and 875 when the half-cylinders are mated to plate 825 and inserted within cavity 885. An object is passed through apertures 890, 870 and 875, holding engagement subsystem 805 within attachment subsystem 810. Interface element 800 is localized as described above.

Figure 9:
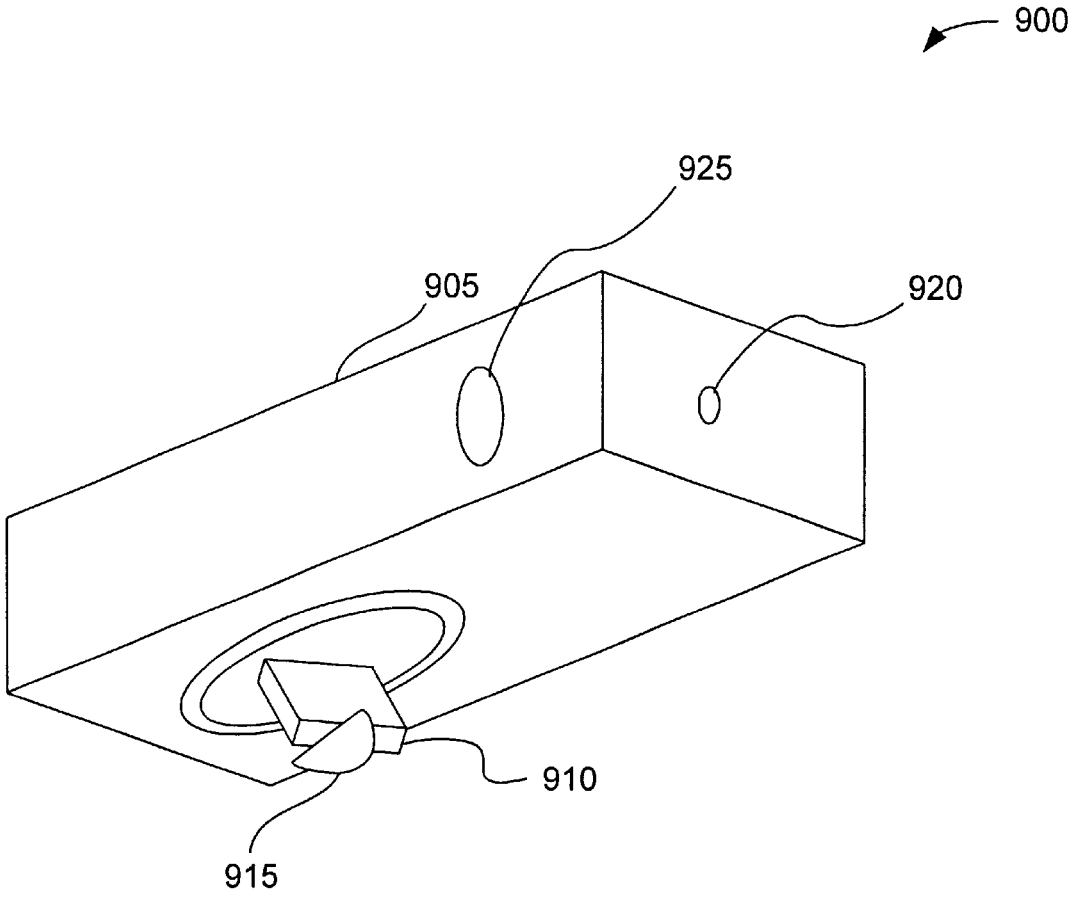
FIG. 9 is a perspective view of an alternate preferred embodiment for an interface element in a locked configuration.

FIG. 9 is a perspective view of a preferred embodiment for an interface element 900 useable as interface element 115 shown in FIG. 1 illustrated in the locked configuration, but outside security slot 110 for ease of reference. Interface element 900 includes a housing 905 having a slot-engaging member 910 extending from a bottom. Pivotally coupled to slot engaging member 910 is a locking arm 915 that rotates about a shaft having an axis of rotation that is generally perpendicular to and passes through security slot 110. Locking arm 915 and its position relative to slot engaging member 910 define the unlocked and locked configurations for interface element 900. When locking arm 915 is aligned with slot engaging member 910, interface element 900 is in the unlocked configuration. When locking arm 915 is misaligned with slot engaging member 910, interface element 900 is in the locked configuration. Locking arm 915 is biased in the locked configuration, and is operated to the unlocked configuration by activation of a reset accessed through aperture 920 as long as the reset is activated. Release of the reset returns locking arm 915 to the locked configuration. Housing 905 includes an aperture 925 for receipt of a cable that may be part of localizer 125. Passing an object through aperture 925 blocks access to the reset, inhibiting reset of locking arm to the unlocked position. In certain applications, slot-engaging member 910 may be coupled to a coupling element 930 that is rotatable within housing 905 to allow rotation of housing 905 when interface element 900 engages security slot 110. In operation, locking arm 915 is moved to the unlocked configuration by activation of the reset through channel 920, and slot-engaging member 910 is inserted within security slot 110. Locking arm 915 is moved to the locked configuration to misalign itself with security slot 110 by release of the reset. Additionally, since locking arm 915 is biased, locking arm 915 may be manually aligned and inserted. An object is passed through aperture 925 and interface element 900 is localized as described above.

Figure 10:
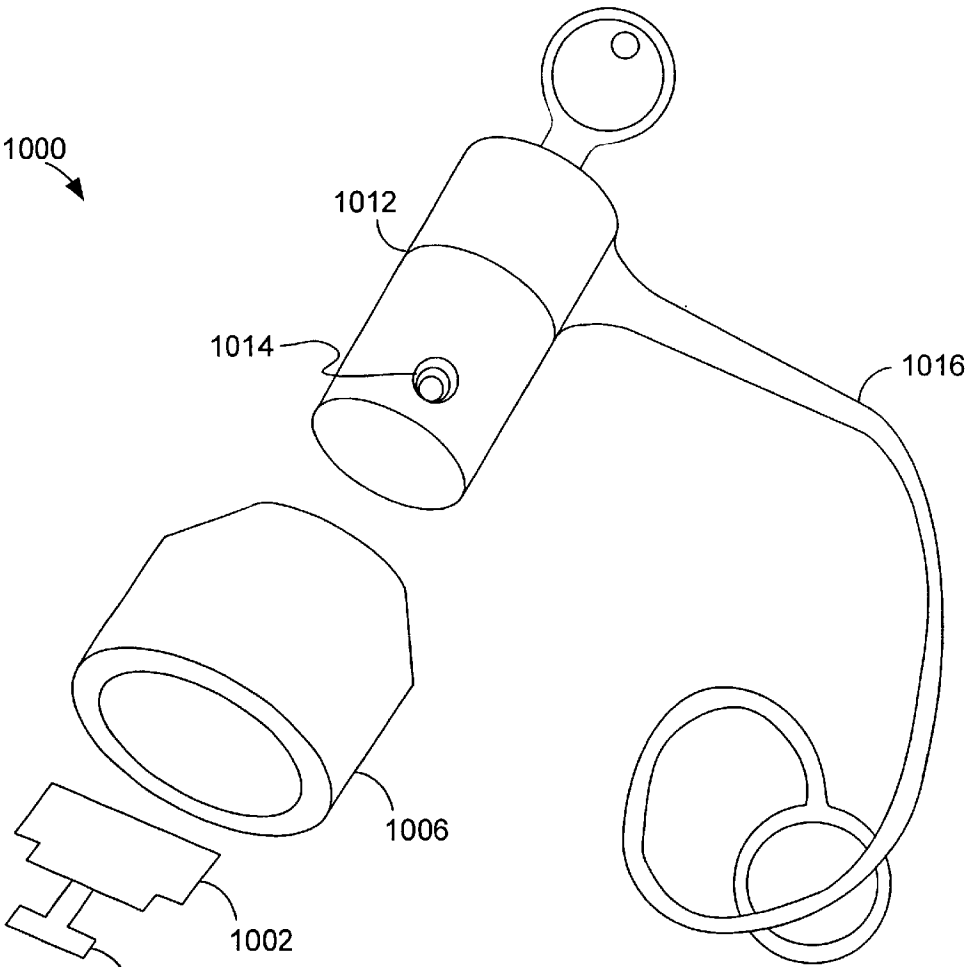
FIG. 10 is an expanded perspective view of an alternate preferred embodiment for an interface element in a locked configuration.
Figure 10B:
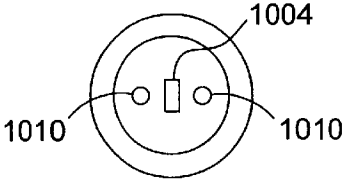
FIG. 10B is a bottom elevation view of components for the interface element illustrated in FIG. 10.
Figure 10A:
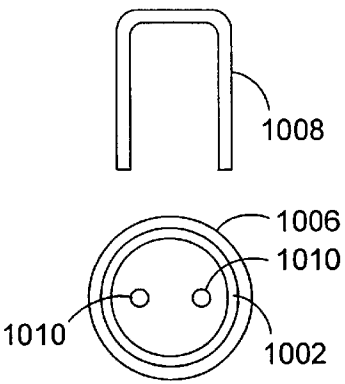
FIG. 10A is an plan view of components for the interface element illustrated in FIG. 10.

FIG. 10 illustrates another interface element 1000. The element includes a slot adapter 1002 that includes a T-shaped locking member 1004 built-in. The slot adapter is inserted into a cylindrical housing 1006, and then both parts are placed such that the locking member extends into the slot. The two pieces are turned ninety degrees, and U-shaped element 1008 is inserted into holes 1010. Now the locking member is fixed within the slot. To make it impossible to remove the U shaped element, a lock 1012 with at least one expandable ball bearing 1014 fits into the cylindrical housing and locks. The ball bearing(s) expand into groove(s) defined within the cylindrical housing to hold the slot adapter in the cylindrical housing. The ball bearings may be spring biased or expand with a gear-type device. A localizer 1016 is coupled to the lock and a separate object as described above.

Figure 12:
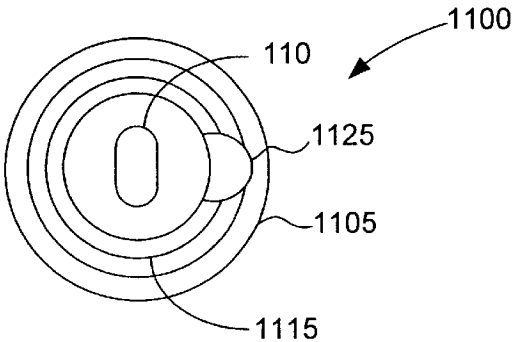
FIG. 12 is an overhead view of the interface element shown in FIG. 11.
Figure 11:
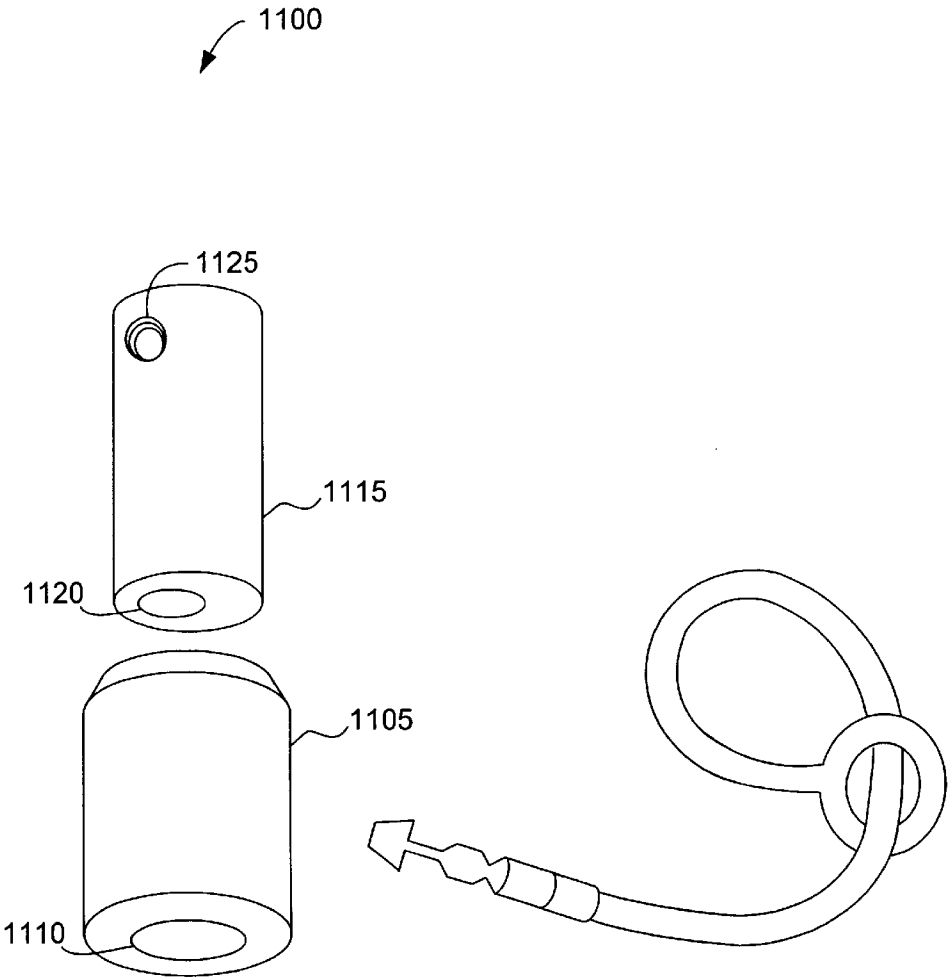
FIG. 11 is an expanded perspective view of an alternate preferred embodiment for an interface element in a locked configuration.

FIG. 12 is an overhead view of interface element 1100 shown in FIG. 11. Interface element 1100 includes a first housing 1105 having an axial aperture 1110, a cylindrical cavity and a top rim. A second housing 1115 that telescopes within the cavity of first housing includes an off-axis aperture 1120, and a retained ball bearing 1125, activatable by use of a security slot 110 defined in a top of second housing 1115. When a locking element is inserted and retained within security slot 110, it extends ball bearing 1125 and prevents it from being pushed inwardly. Extraction of the locking element from security slot 110 permits ball bearing 1125 to be pushed inwardly.

In operation, second housing 1115 is telescoped within cavity of first housing 1105 sufficient to place ball bearing 1125 within the top rim. Activation of ball bearing 1125 by use of security slot 110 retains second housing 1115 within first housing 1105. Localization is achieved by use of a cable 1150 having a ferrule at one end sized to fit within the apertures of first housing 1115 and second housing 1105. The eccentric apertures engage and secure the ferrule, thereby securing cable 1150 to the housings as long as the housings are telescoped.

Figure 13:
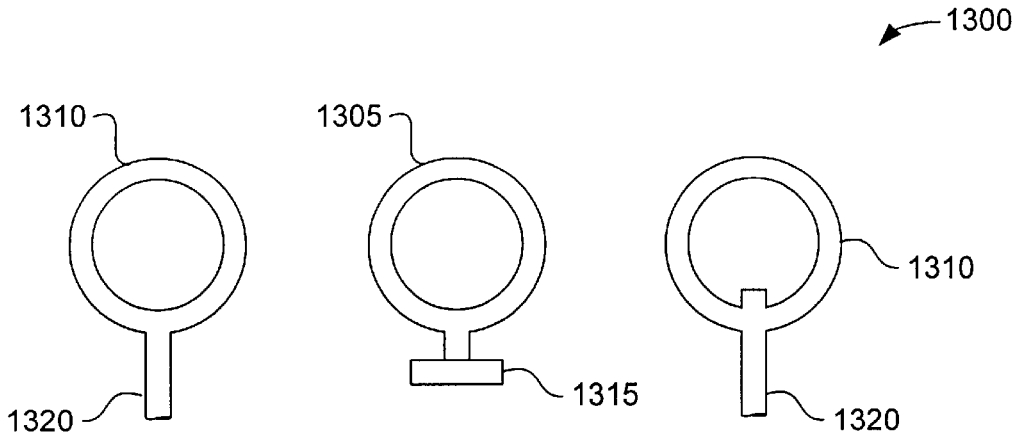
FIG. 13 is an expanded perspective view of an alternate preferred embodiment for an interface element in an unlocked configuration.
Figure 14:
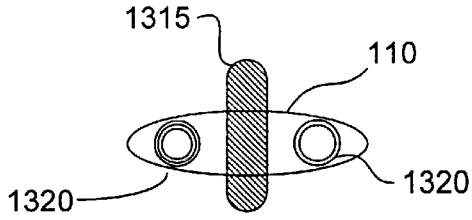
FIG. 14 is a plan view showing locking elements of FIG. 12 engaging a security slot.

FIG. 13 is a perspective view of a preferred embodiment for an interface element 1300 useable as interface element 115 shown in FIG. 1 illustrated in the unlocked configuration, but outside security slot 110 for ease of reference. FIG. 14 is a view of interface element 1300 shown in FIG. 13 engaging a security slot. Interface element 1300 includes a first ring 1305 and two second rings 1310, each having a central aperture. First ring includes a slot engagement element 1315 sized to fit within security slot 110, and designed to be misalignable with security slot 110 to be retained within slot 110. In the preferred embodiment, slot engagement element 1315 is "T-shaped" though other applications or uses may provide for "L-shaped" structures or other configurations. Second rings 1310 include a pin element 1320.

In operation, slot engagement element 1315 is inserted with slot 110 and misaligned with the slot. The second rings 1310 are juxtaposed to first ring 1305 with pin elements 1320 within the slot and on each side of slot engagement element 1315 with all central apertures aligned. An object is passed through the central apertures and interface element 1300 is localized as described above.

Figure 15:
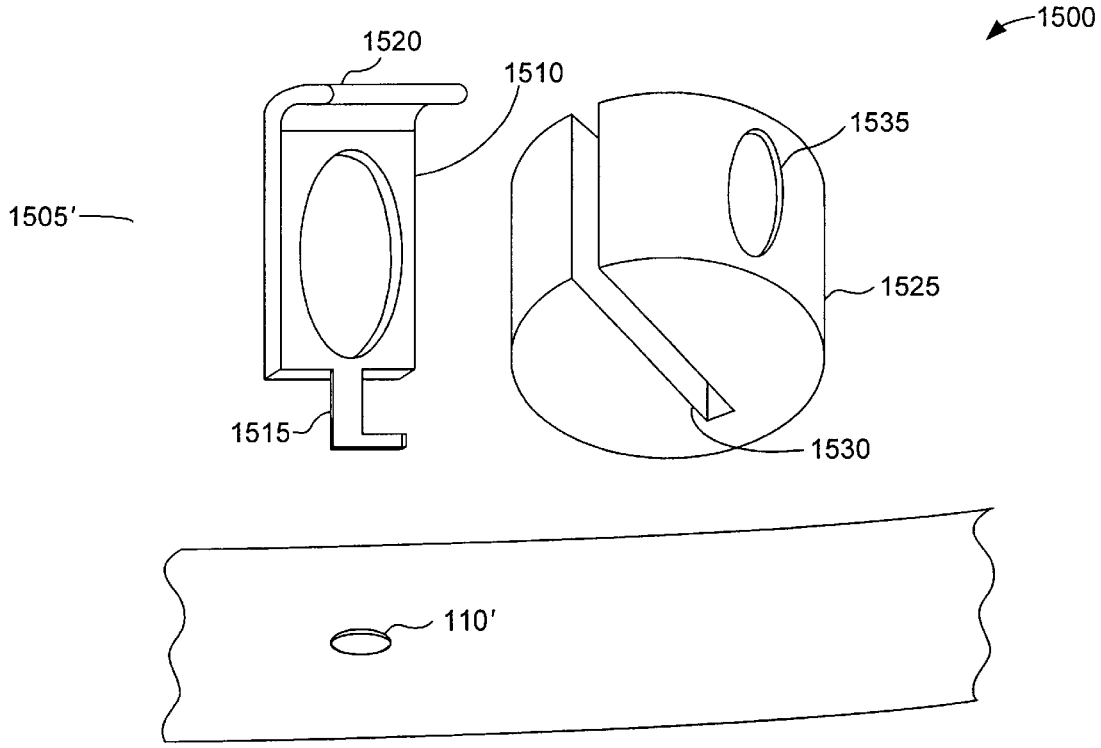
FIG. 15 is an expanded perspective view of an alternate preferred embodiment for an interface element in an unlocked configuration for use with a circular security slot.

FIG. 15 is a perspective view of a preferred embodiment for an interface element 1500 useable as interface element 115 shown in FIG. 1 illustrated in the unlocked configuration, with a security slot 110' being a small circular hole about 2 mm in diameter for this application. Interface element 1500 includes an engaging member 1505 having a body 1510, a slot engaging element 1515, and a flange 1520, and a housing 1525. Body 1510 is a generally flat metal element having a central aperture. Slot engaging element 1515 being generally "L-shaped" having a length extending from body 1510 sufficient to allow element 1515 to enter into slot 110'. Body 1510, element 1515 and flange 1520 are preferably all formed from a metal sheet about 2 mm thick, with the element 1515 and flange 1520 bent from the ends of the metal sheet. Housing 1525 having a slot 1530 slightly wider than a thickness of body 1510, and includes an aperture 1535 passing through and aligned with the central opening in body 1510 when body 1510 is inserted into slot 1530.

In operation, body 1510 is tilted to allow element 1515 to be inserted into slot 110'. Body 1510 is righted to extend generally perpendicular to a wall defining slot 110' and to retain element 151 within slot 110'. Body 1510 is inserted into slot 1530 until aperture 1535 aligns with the central opening of body 1510. Housing 1525 has a height slightly less that a distance between flange 1520 and the wall defining slot 110' when element 1515 is retained. Housing 1525 maintains body 1510 upright, preventing it from being tilted to permit removal of element 1515 from out of slot 110'. Flange 1520 facilitates the removal of body 1515 from out of slot 1530 when interface element 1500 is to be removed. An object is passed through aperture 1535 and interface element 1500 is localized as described above.

What is claimed is:

1. An interface element for a security slot having dimensions of about 3 mm by 7 mm, comprising:

a plate;

a slot engagement member, coupled to said plate, sized to enter into the security slot;

a ring, coupled to said slot engagement member, and sized to enter into the security slot; and a ring adjustment system for configuring said ring to be unremovable from within the security slot.

2. The interface element of claim 1 wherein said ring adjustment system plastically deforms said ring to inhibit removal from with the security slot.

* * * * *